United States Patent [19]

Wise

[11] Patent Number: 4,878,862

[45] Date of Patent: Nov. 7, 1989

[54] CONNECTOR FOR MATING TWO BUS BARS

[75] Inventor: James H. Wise, Palmyra, Pa.

[73] Assignee: AMP Incorporated, Harrisburg, Pa.

[21] Appl. No.: 280,108

[22] Filed: Dec. 5, 1988

[51] Int. Cl.[4] ..... H01R 13/10

[52] U.S. Cl. ..... 439/787; 29/876; 439/857

[58] Field of Search ..... 439/723, 724, 786, 787, 439/845, 856–858, 249, 250, 251; 200/254, 255, 282; 29/874, 876, 877, 884

[56] References Cited

U.S. PATENT DOCUMENTS

| | | | |
|---|---|---|---|
| 3,400,303 | 9/1968 | Rowlands et al. | 361/355 |
| 3,893,233 | 7/1975 | Glover | 174/72 B |
| 4,133,101 | 1/1979 | Glover | 29/628 |
| 4,203,646 | 5/1980 | Desso et al. | 439/787 |
| 4,486,636 | 12/1984 | Prietzel et al. | 439/723 |
| 4,591,219 | 5/1986 | Reimer | 439/723 |
| 4,637,677 | 1/1987 | Barkus | 439/724 |
| 4,684,191 | 8/1987 | Feher et al. | 439/246 |

*Primary Examiner*—Neil Abrams
*Attorney, Agent, or Firm*—Katherine A. Nelson

[57] ABSTRACT

An electrical connector 10 for mating two blade-shaped members, such as dual voltage bus bars 84, 92 is disclosed. The connector 10 is comprised of first and second terminal elements 12, 40 having body sections 14, 42 secured together with insulating means 38 therebetween. Each first and second terminal element 12, 40 has a first array 24, 52 of spaced cantilevered spring contact arms 26, 54 respectively extending outwardly from a respective leading edge, 20, 48 and a second array 32, 58 of spaced cantilevered spring contact arms 34, 60 extending outwardly from a respective trailing edge, 22, 50. The corresponding spring contact arms of the first and second arrays of terminal elements 12, 40 are interlaced proximate the leading and trailing edges of body members 14, 42 such that spring contact arms 26, 54 of first arrays 24, 52 define a first blade-receiving receptacle 64, and spring contact arms 34, 60 of second arrays 32, 58 define a second blade-receiving receptacle 72, receptacles 64, 70 being aligned with secured together body sections 14, 42 and having first sides 66, 72 and second sides 68, 74 corresponding to body sections 14, 42 of first and second terminal elements 12, 40 respectively.

18 Claims, 4 Drawing Sheets

CONNECTOR FOR MATING TWO BUS BARS

FIELD OF THE INVENTION

This invention is related to the field of electrical connectors and more particularly to an electrical connector for interconnecting to blade-shaped members.

BACKGROUND OF THE INVENTION

In forming a power distribution system it is necessary to provide means for a hot line carrying power to the required load and a return line to the power source. In a typical power distribution system for an integrated circuit logic system as many as ten interconnections may be required. There are connections between power supply and bus bar, bus bar and a mother board, a mother board and the daughter board, and connections between the daughter board and socket in which chips are usually mounted and a connection between the socket and an actual integrated circuit. Thus there are five points of interconnection in the line going from the hot terminal to the load and another five points of interconnection complete the return line of the circuit. In many integrated circuit systems there can be no more than 250 millivolts of drop in the voltage at each load. Some logic systems furthermore require multiple voltage power distribution systems. These systems therefore require electrical connectors or contacts that will minimize voltage drops as the load is placed on the system.

The speed at which the systems are operated is continually being increased as technology advances. To accommodate the ever quickening rate of change in the current draw, power distribution systems were generally provided with capacitors mounted on the various boards to store current that would be readily available as the demands from the load change. This lumped element method presents problems in that there is insufficient space available to accommodate larger capacitors required for higher speed logic families or higher rates of change in current demand.

To overcome problems associated with the earlier systems, it is desirable that power distribution systems be designed that are essentially equivalent to distributed element tuned circuits or transmission lines. By making a wide bus bar or conductor and by placing the hot and return conductors in close proximity such as forming a laminated bus bar, a high distributed capacitance can be achieved. This construction also gives a low resistance R, and inductance L. The bussing structure itself becomes a capacitor C and stores a large amount of the current that is needed to accommodate the rapidly changing load and in addition the current is distributed along the length of the entire bus structure. To minimize the distance between adjacent conductive layers, a very thin insulative layer is disposed between them to form a capacitive element and to prevent arcing.

One problem associated with laminated bus bars, however, is the inability to use standard two sided receptacle contacts to interconnect the laminated bus bar with another or to terminate to the laminated bus bar since a standard contact will electrically short the outer most conductive layers of the bus bar. Typically interconnections to laminated bus bars are made by providing the bus bar layers with tabs that extend outwardly from the various layers to which a wire or contact may be bolted to one voltage or layer. Since the wide bus bars are good conductors of heat as well as electricity, it is extremely difficult to achieve effective connections to the bus bar by soldering techniques. U.S. Pat. Nos. 3,400,303 and 3,893,233 disclose means for providing tabs and contact arrangements for providing input, output and ground connection to such laminated bus bars, one layer at a time. In addition to requiring bolted type connections or the like the use of tabs also prevents a controlled impedance system characteristic of tuned circuits and transmission lines. It is desirable therefore to provide a means for connecting to a laminated bus bar system that essentially controls any changes in the impedance of the system such as is required by high speed systems.

Furthermore it is desirable to have a separately means for connecting to the laminated bus bar system that retains the "plugability" of the system.

U.S. Pat. App. Ser. No. 07/169,514 filed Mar. 17, 1988 and assigned to the assignee hereof discloses a receptacle terminal for severable interface for power interconnection to a single layer bus bar. The terminal is comprised of a stamped and formed member having opposing spring arms which together act as a flared receptacle to receive a thick planar along the bus bar therebetween. The bus bar engages contact sections of the spring arms and deflects the stiff spring arms outwardly thereby generating a sufficient contact normal force between the terminal and the bus bar. The terminal further includes a pair of opposed plate sections joined by a lateral bite extending rearwardly from the spring arms and having an aperture extending therefrom for providing connection to a conventional ring tongue terminal terminated to a power cable. U.S. Patent No. 4,684,191 discloses a similar terminal comprising two cast metal members having arrays of opposed contact arms. The terminal is connected to a conventional ring tongue terminal terminated to a power cable. While the previously described terminals are suitable for connecting to bus bars, the bus bars are ones that comprise a single unit carrying a single voltage. These terminals are unsuitable for use with laminated bus bars since they would provide an electrical connection or short between the outer conductive layers of the laminated bus bar.

SUMMARY OF THE INVENTION

Accordingly the present invention is directed to a connector that can carry high currents of two different voltages across an interface.

It is the object of the present invention to provide a separable connection between a connector and two bar-shaped members, such as bus bars, circuit panels or the like, thus maintaining the plugability of the members into the connector.

More particularly it is an object of the invention to provide for separable connections between two laminated bus bars.

It is an additional object of the invention to provide a means whereby the characteristic impedance of the system remains essentially controlled.

Additionally it is an object of the invention to provide a tuned power distribution system wherein discontinuities are minimized.

It is another object of the invention to provide a means for connecting members to and disconnecting members from a multivoltage power system.

In addition it is an object of the invention is to provide a connector that allows very low values of inductance and resistance and very high values of capacitance.

A further object of the invention is to provide a connector construction that requires no application of force from secondary components to maintain a normal force needed at the contact points of the connector.

Accordingly the present invention is directed to a electrical connector for mating two blade-shaped members, each having opposed first and second sides. The connector comprises first and second terminal elements having body sections secured together with insulating means therebetween. The body members include inwardly and outwardly facing major surfaces and leading and trailing edges. Each first and second terminal element has a first array of spaced cantilevered spring contact arms extending outwardly from a respective leading edge and a second array of spaced cantilevered spring contact arms extending outwardly from respective trailing edge. The spring contact arms of both of the first and second arrays of each terminal element further extend outwardly from the plane of the respective body sections toward the other terminal element and into the spacing between contact arms of respective first and second arrays of the other terminal element. The spring contact arms of the first arrays of the elements define a first blade-receiving receptacle between the free ends thereof and the second contact arms of the second arrays of the elements define a second blade-receiving receptacle between the free ends thereof.

The first and second blade-receiving receptacles are aligned with the secured together body section and have first and second sides corresponding to the body sections of the first and second terminal elements respectively. The free ends of the contact arms of the first and second arrays of the first terminal element are disposed along the second side of the first and second blade-receiving receptacles respectively and are adapted to be deflected outwardly by a corresponding second sides of respective first and second mating blade-shaped members. The free ends of the spring contact arms of the first and second arrays of the second terminal element are disposed along the first side of the first and second blade-receiving receptacles respectively and are adapted to be deflected outwardly by corresponding first sides of respective first and second mating blade-shaped members. Deflection of the free ends of the contact arms of each terminal element during connector mating by insertion of first and second blade-shaped members into respective first and second receptacles urges the body sections of the two terminal elements more closely against each other.

The preferred embodiment of the invention further includes a housing means to hold the two terminal elements and the intermediate dielectric member in position for mating to the blade-shaped members. The housing means is also used to mount the connector of the present invention in a desired location for mating to two bar shaped members. In accordance with the preferred embodiment the bar shaped members are laminated dual voltage bus bar members. Once the bus bar members have been mated with the connector of the present invention, the connector is in effect "self supporting" in that the housing means is not necessary for providing sufficient normal force of the contact arms against the bus bar members.

The present invention is also directed to a means for making the electrical connector in accordance with the invention.

The invention itself, together with further objects and its intended advantages, will be best understood by reference to the following detailed description taken in conjunction with the accompanying drawings.

DETAILED DESCRIPTION OF THE DRAWINGS

Figure 1:
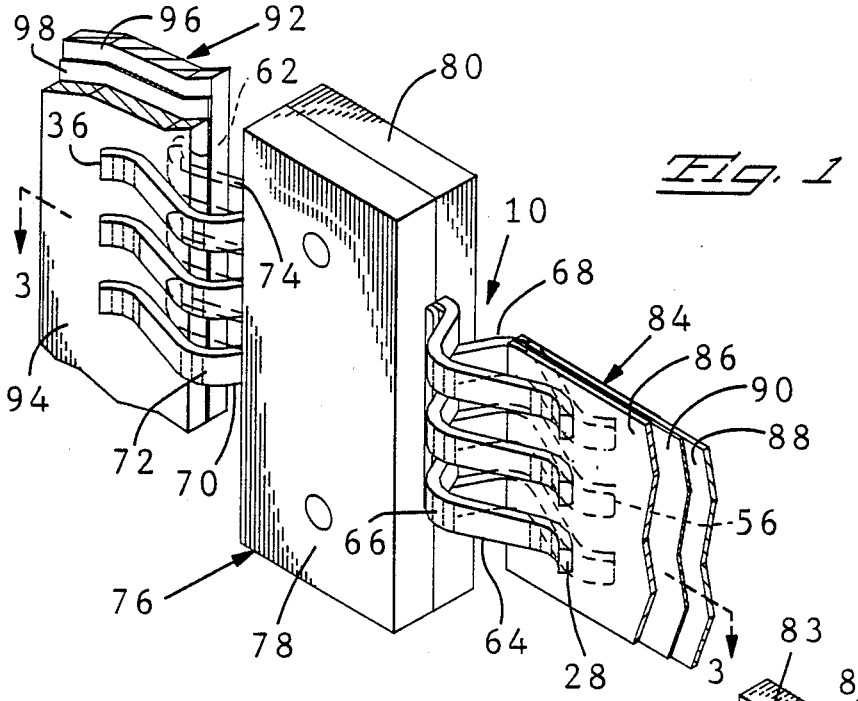
FIG.1 is a perspective view of the preferred embodiment of the connector mated to fragmentary portions of laminated bus bar members.
Figure 2:
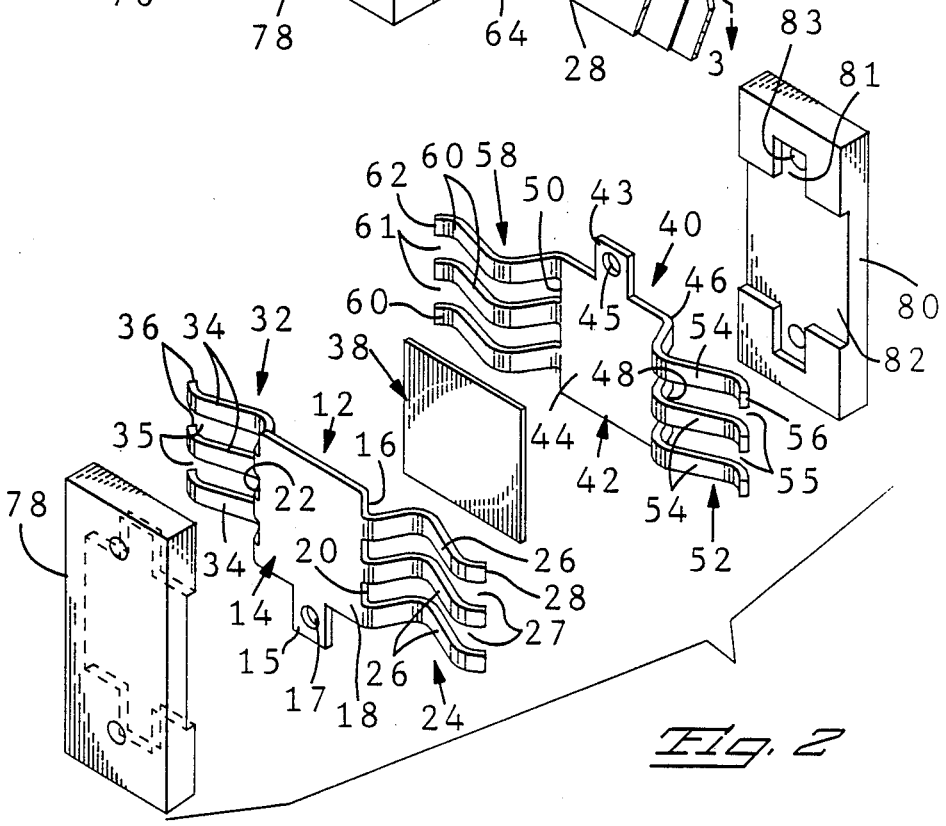
FIG. 2 is an exploded view of the connector of FIG.1.
Figure 3:
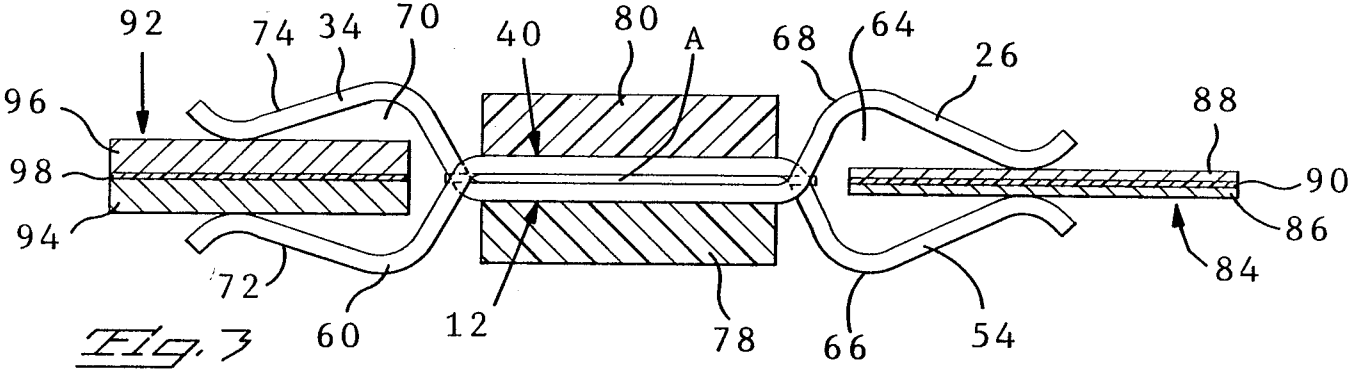
FIG. 3 is a top plan view of the mated connector of FIG.1 taken along lines 3—3 of FIG. 1.
Figure 4:
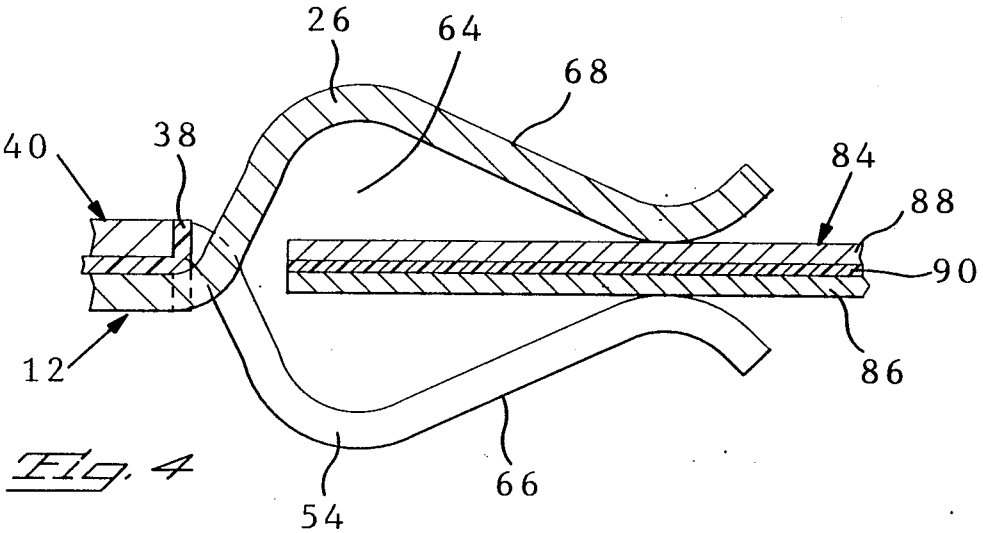
FIG. 4 is an enlarged cross sectional view of a fragmentary portion of the connector of the present invention.

Referring now to FIG. 1 through 4, electrical connector 10 of the present invention is comprised of first and second terminal elements 12, 40 having body sections 14, 42 secured together with insulation means 38 therebetween. As best seen in FIG. 2, first body section 12 includes inwardly and outwardly facing major surfaces 16, 18 and leading and trailing edges 20, 22 respectively. Second terminal element 40 includes inwardly and outwardly facing surfaces 44, 46 and leading and trailing edges 48, 50 respectively. In the assembled connector 10 as best seen in FIG. 3, inwardly facing surface 16 of first terminal element 14 faces a first direction and inwardly facing body surface 44 of second terminal element 40 faces an opposed second direction with insulating means 38 therebetween. To control the impedance, it is necessary that the two body members 14, 42 overlap each other in all areas.

Referring again to FIG. 2, first terminal element 12 has a first array 24 of spaced cantilever spring contact arms 26 extending outwardly from leading edge 20 and a second array 32 of spaced cantilevered spring contact arms 34 extending outwardly from trailing edge 22. Second terminal element 40 has a first array 52 of spaced cantilevered spring contact arms 54 extending outwardly from leading edge 48 and a second array 58 of spaced cantilevered spring contact arms 60 extending outwardly from trailing edge 50. In the preferred embodiment contact arms 26, 34, 54, 60 have flared ends 28, 36, 56 and 62 respectively. Spaces 27, 35 between adjacent first and second contact arms 26, 34 respectively are greater than the width of the second element spring contact arms 54, 60. Spaces 55, 61 between adjacent first and second contact arms 54, 60 respectively are greater than the width of the first element spring contact arms 26, 34.

In the assembled connector 10 the spring contact arms 26, 34 of the first arrays 24, 32 of terminal element 12 extend outwardly from the plane of body section 14 toward the other terminal element 40 and into spaces 55, 61 between contact arms 54, 60 of arrays 52, 54 of terminal element 40 as best seen in FIG. 3. Correspondingly the spring contact arms 54, 60 of the first and second arrays 52, 58 of second terminal element 40 extend outwardly from the plane of body section 44 toward first terminal element 12 and into corresponding spaces 27, 35 between contact arms 26, 34 of arrays 24, 32 of first terminal element 12. The spring contact arms 26, 54 of the first arrays 24, 52 of respective first and second terminal elements 12, 40 define a first blade-receiving receptacle 64 between the free ends 28, 56 thereof. The spring contact arms 34, 60 of the second arrays 32, 58 of respective first and second terminal elements 12, 40 define a second blade-receiving receptacle 70 between free ends 36, 62 thereof. First and second blade-receiving receptacles 64, 70 formed by respective interlaced contact arms, are aligned with the secured together body sections. First and second blade-receiving receptacles 64, 70 have first sides 66, 72 and second sides 68, 74 corresponding to first and second body sections 14, 42 of first and second terminal elements 12, 40 respectively. Free ends 28, 36 of first and second arrays 24, 32 respectively of first element 12 are disposed along a second side 68, 74 of first and second blade-receiving receptacles 64, 70 respectively. The free ends 56, 62 of spring contact arms 54, 60 are disposed along the first sides of first sides 66, 72 of first and second blade-receiving receptacles 64, 70 respectively.

In the preferred embodiment, first and second blade-receiving receptacles 64, 70 are essentially tulip shaped and are designed to receive first and second blade-shaped members 84, 92 therein. It is to be understood that other contact arm or beam shapes may be used. The blade-shaped members 84, 92 have first sides 86, 94 and second sides 88, 96 respectively. In the preferred embodiment first and second blade members 84, 92 are laminated bus bar members. Insulating layer 90 is disposed between respective first and second sides 86, 88 of first blade members and insulating layer 98 is disposed between first and second sides 94, 96 of second blade member 92. Preferably the ends of each contact arm is flared outwardly to provide a lead in for blade-receiving receptacles 64, 70.

When the blade-shaped members 84, 92 are mated with the connector 10 of the present invention, free ends 28, 36 of spring contact arms 26, 34 of first terminal element 12 are adapted to be deflected outwardly by the corresponding second sides 88, 96 of first and second blade members 84, 92 and free ends 56, 62 of first and second contact arms 54, 60 of second terminal element 40 are adapted to be deflected outwardly by corresponding first sides 86, 94 of respective first and second mating blade-shaped members 84, 92. Deflection of the free ends 28, 36 of contact arms of first terminal element 12 during mating by first and second blade-shaped members 84, 92 urges body section 14 of first terminal element more tightly against the body section 42 of the second terminal element. Concomitantly deflection of the free ends 56, 62 of contact arms 54, 60 of the second terminal element 40 urges the body section 42 of that terminal element 40 more tightly against the body section 14 of terminal element 12. This deflection provides a sufficient normal force for electrically connecting the bar shaped members 84, 92 with the corresponding blade-receiving receptacles 64, 70.

The number of contact arms formed on each terminal element depends upon the width of the bar shaped member, the amount of current to be carried through the system and the amount of normal force that must be exerted by the contact arms on the bar-shaped member. Generally it is desirable to spread the normal force among as many contact arms as possible to minimize the stress exerted on the bar-shaped members. For example if excessive stress is exerted on a dual laminated bus bar the thickness of the dielectric layer between the two conductive layers may be sufficiently reduced to cause impedance changes in the system.

In its preferred embodiment connector 10 further includes housing means 76 comprised of first and second members 78, 80 and defining a cavity 82 therebetween for receiving and holding first and second terminal elements 12, 40 and dielectric member 38 disposed therebetween and having respective arrays 24, 32, 52, 58 of contact arms extending outwardly therefrom. As best seen in FIG. 2, first and second terminal elements 12, 40 further include tab portions 15, 43 respectively having apertures 17, 45 respectively extending therethrough for receiving means for securing the housing and terminal elements together.

Figure 5A:
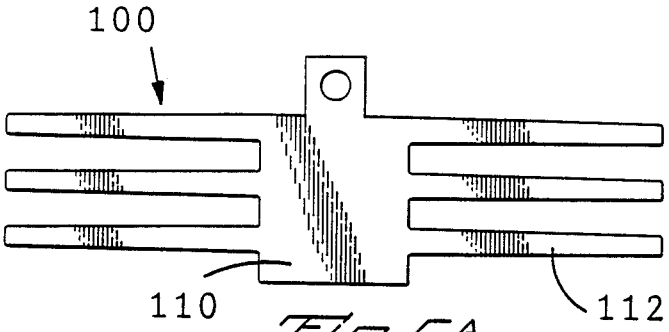
FIGS. 5A, 5B and 5C illustrate method steps in making the preferred embodiment of the connector of the present invention.
Figure 5B:
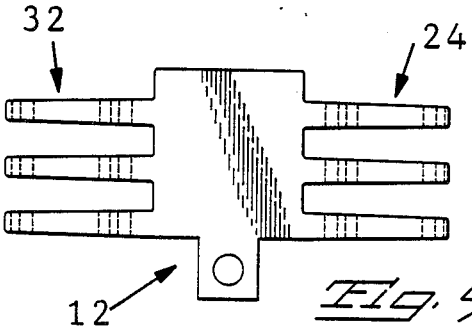
Figure 5C:
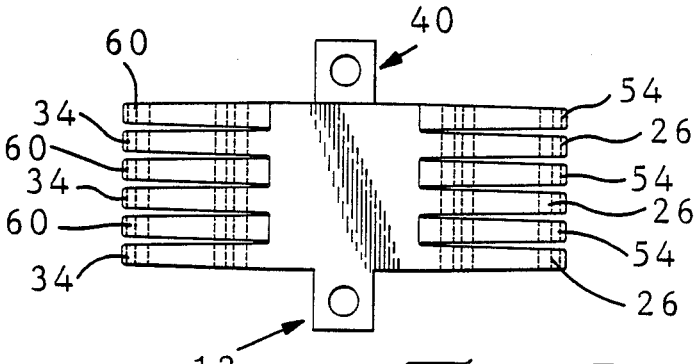

In the preferred embodiment, the first and second terminal elements 12, 40 are hermaphroditic. The steps in producing connector 10 can be seen in FIGS. 5A, 5B and 5C. In making the preferred embodiment of the invention a plurality of terminal element blanks 100 are stamped from a continuous strip of metal as seen in FIG. 5A. The blanks 100 include a body portion 110 and a plurality of outwardly extending arms 112. The blanks 100 are severed from the strip and the outwardly extending arms 112 are formed into arrays of the contact arms having the desired configuration of the respective terminal elements as shown in FIG. 5B. The blanks are adapted so that one formed terminal element may be rotated 180° and superimposed on a second formed terminal element with a layer of insulation disposed therebetween to form the electrical connector 10 of the present invention as shown in FIG. 5C. To control the impedance, it is necessary that the two body members 14, 42 overlap each other in all areas.

The insulation may be provided by stamping the shape of the body portion of the respective terminal elements from a sheet of flexible insulating material or may be a molded member with the dielectric material preferably extending along the leading and trailing edges of the body and between the respective contact arms thus insuring that the interlaced contact arms of the two body sections 14, 42 will not come into electrical contact with one another in the assembled connector. Suitable insulating materials include flexible materials as known in the such as MYLAR available from E. I. DuPont de Nemours & Co., and materials such as ceramics and other known materials that may be cast or molded by a variety of methods as known in the art.

Figure 6:
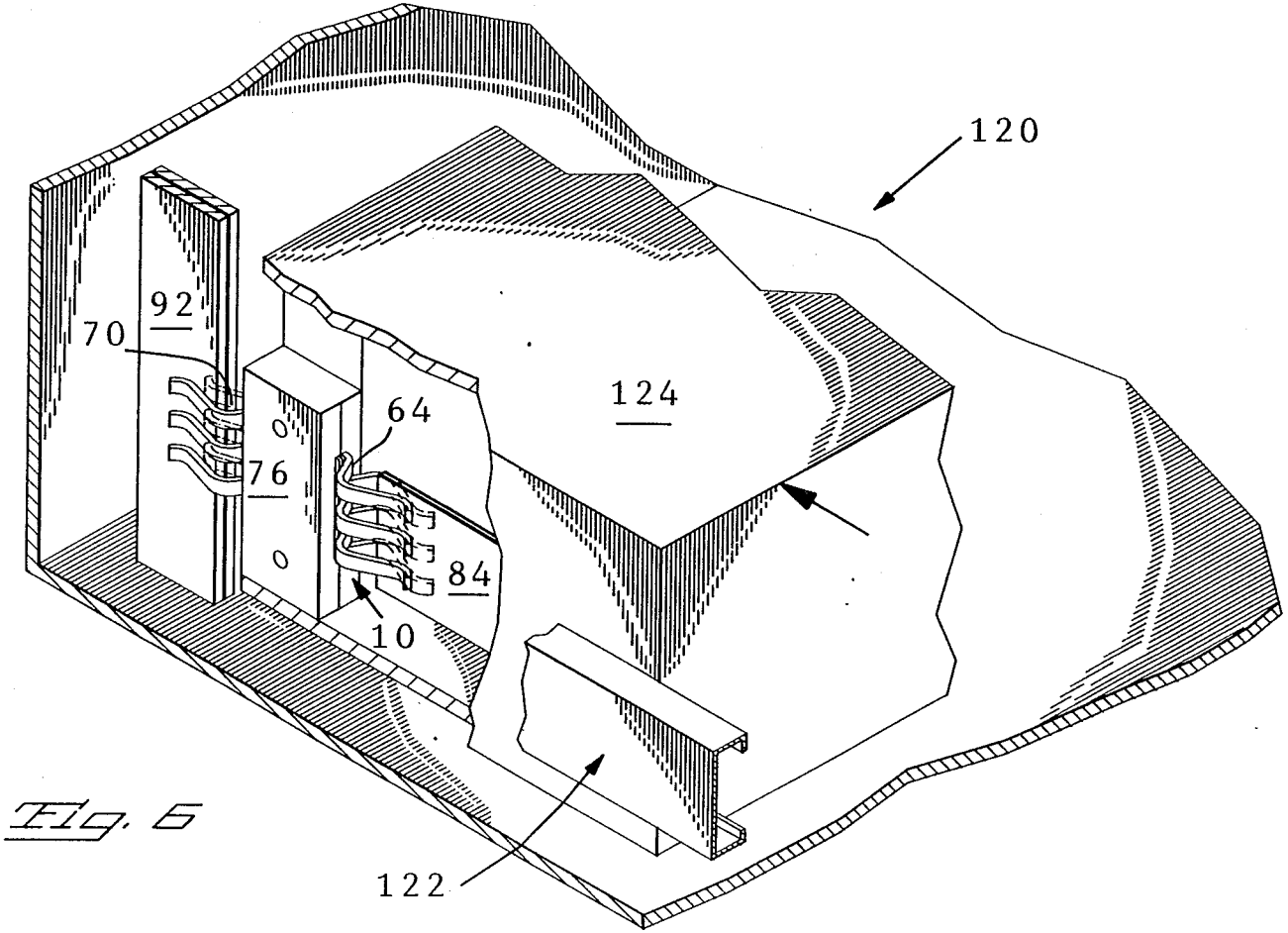
FIG. 6 illustrates the use of the connector of the present invention in a modular connector system.

The dielectric housing member 76 is preferably formed in two hermaphroditic portions, 78, 80, which have extensions 81 for receiving respective tab members 15, 43. Housing portions 78, 80 further include apertures 81 which correspond to apertures 17, 43 in terminal elements 12, 40 respectively for securing the connector together and for mounting connector 10 to a device with insulated means such as insulated sleeves and bolts, as known in the art. Housing member 76 can be further used as a means for mounting the connector 10 for example in modular drawer assembly 120 or other device for mating with two bar shaped members 84, 92 such as shown in FIG. 6. It is to be understood that the bar shaped members may be laminated bus bars having different thicknesses, or may be circuit boards or a bus bar and a circuit board or other flat bar shaped members.

As shown in FIG. 6, the fragmentary portion of a drawer assembly 120 mounted within a frame wherein the connector 10 is mounted to a structure within the drawer member 124 with a laminated bus bar member 84 of the drawer member 124 engaged in a first blade-receiving receptacle 64 and the drawer member 124 inserted into the frame 122 such that the second blade-receiving receptacle 70 is blind matable with vertically extending bus bar member 92. It is to be understood that the bus bar. members of the drawer and frame may be vertical members, horizontal members or a combination thereof.

As can be seen from the Figures, the present invention provides an electrical connector having a single electrical contact that can carry high currents of two different voltages across an interface. The construction allows precise control of the characteristic impedance of the connector. The values of the resistance, inductance and capacitance for the connector can easily be customized by changing the type and/or thickness of dielectric material and the dimensions of the overlapped body portions 14, 42 of the first and second terminal elements 12, 40 respectively. The connector 10 is essentially self supporting in that it requires no secondary components to provide a sufficient normal force for engaging the respective bar-shaped members. The present invention further allows the replacement of two single voltage bus bars by a dual voltage laminated bus bar. The single connector maintains the necessary normal forces at the separated interfaces by the action of the cantilevered contact arms or beams anchored to the common body. The structure is such that the greater amount of deflection of the cantilevered arms or beams causes a greater force between the two opposed body portions of the terminal elements and is self supporting.

Different thicknesses of bus bars can be accommodated by adjusting the beam bending dimensions of the first or second arrays of corresponding terminal elements. As shown in FIG. 3, dimension A, the distance between the two body portions 14, 42 can be held constant while the shape of the outwardly extending contact arms or beams 26, 34, 54, 60 can be changed to accommodate different thickness of mating bar-shaped members. Preferably, it is desired to keep A at a minimum in order maximize the capacitance for any size laminated bus bar arrangement, as is desired in a tuned power systems.

It is to be understood that the present invention is not limited to dual bus bar systems only. Bus bar members having more than two conductive layers may also be electrically connected with this invention providing there is some exposed surface area of the inner layers to which the connector may be engaged.

It is thought that the electrical connector of the present invention and many of its intended advantages will be understood from the foregoing description. Changes may be made in the form, construction and arrangement of parts thereof without departing from the spirit and scope of the invention or sacrificing all of its material advantages.

What is claimed is:

1. An electrical connector for mating two blade-shaped members, each having opposed first and second sides, said connector comprising:

first and second terminal elements having body sections secured together with insulating means therebetween, each said body section including inwardly and outwardly facing major surfaces and leading and trailing edges;

each said first and second terminal element having a first array of spaced cantilevered spring contact arms extending outwardly from a respective said leading edge, and a second array of spaced cantilevered spring contact arms extending outwardly from a respective said trailing edge, said spring contact arms of both said first and second arrays of each said terminal element extending outwardly from the plane of the respective said body sections toward the other said terminal element and into the spacing between said contact arms of said arrays of said other terminal element;

said spring contact arms of said first arrays defining a first blade-receiving receptacle between free ends thereof, and said spring contact arms of said second arrays defining a second blade-receiving receptacle between free ends thereof, said first and second blade-receiving receptacles being aligned with said secured together body sections and having first and second sides corresponding to said body sections of said first and second terminal elements respectively;

said free ends of said spring contact arms of said first and second arrays of said first terminal element being disposed along said second side of said first and second blade-receiving receptacles respectively and adapted to be deflected outwardly by corresponding second sides of respective first and second mating blade-shaped members; and said free ends of said spring contact arms of said first and second arrays of said second terminal element being disposed along said first and second blade-receiving receptacles respectively and adapted to be deflected outwardly by corresponding first sides of respective first and second mating blade-shaped members; whereby deflection of the free ends of the contact arms of each terminal element during connector mating by first and second blade-shaped members urges the body section of one terminal element more tightly against the body section of the other terminal element.

2. The electrical connector of claim 1 further including dielectric housing means disposed on said secured together body section.

3. The electrical connector of claim 2 wherein said housing means further includes means for mounting said electrical connector to a structure.

4. The electrical connector of claim 1 wherein said blade-shaped members includes at least one bus bar.

5. The electrical connector of claim 4 wherein said bus bar is a dual voltage laminated bus bar.

6. The electrical connector of claim 1 wherein said blade-shaped members includes at least one circuit panel.

7. The electrical connector of claim 1 wherein said two blade-shaped members are first and second bus bars.

8. The electrical connector of claim 7 wherein said first and second bus bars are dual voltage laminated bus bars.

9. The electrical connector of claim 8 wherein said first and second laminated bus bars have different thicknesses.

10. The electrical connector of claim 1 wherein said first and second mating blade-shaped members have different thicknesses.

11. The electrical connector of claim 1 wherein said insulating means extends along the leading and trailing edges of at least one body section to insulate the edges between adjacent interlaced contact arms of the connector.

12. The electrical connector of claim 1 wherein the spacing between adjacent contact arms of each said array of contact arms of one said respective terminal element is greater than the width of the contact arms of the other said terminal element such that said respective arrays of contact arms of one of each said respective terminal elements may be interlaced with the contact arms of the other of said respective terminal elements without becoming electrically engaged therewith.

13. The electrical connector of claim 1 wherein said terminal elements are hermaphroditic members.

14. The electrical connector of claim 13 wherein said hermaphroditic members are oppositely oriented.

15. A terminal element comprising:

a body section having leading and trailing edges; and opposed first and second contact sections extending outwardly from a respective leading and trailing edge of said body section, said first and second contact sections including an array of cantilevered spaced apart contact arms adapted to be deflected in a common direction by a mating blade-shaped member;

said terminal element being adapted to be joined to an oppositely oriented terminal element with insulating means therebetween such that said arrays of contact arms are disposed between arrays of contact arms of said oppositely oriented terminal element thereby defining two blade-receiving receptacle members therebetween.

16. The terminal of claim 15 wherein said contact arms of said terminal element have ends that flare outwardly from the contact arm whereby when said terminal element is joined to said oppositely oriented terminal element, said ends define respective flared openings for said blade-receiving receptacle members.

17. A method of making a connector for interconnecting to bus bar members, comprising the steps of:

forming first and second terminal elements having body sections including inwardly and outwardly facing major surfaces and leading and trailing edges;

forming first and second arrays of spaced cantilevered spring contact arms extending outwardly from respective leading and trailing edges of said first and second terminal elements;

disposing a layer of insulation means over at least one of said first and second body portions;

orienting said first and second terminal elements with respect to each other such that the said spring contact arms of said first and second arrays of a first terminal element extend outwardly from the body section toward the other terminal element and into the spacing between said contact arms of said arrays of said other terminal element, such that said contact arms of said first arrays define a first blade-receiving receptacle between free ends thereof and said spring contact arms of said second arrays define a second blade-receiving receptacle between free ends thereof; and securing said body portions and insulating means together such that said first and second blade-receiving receptacles are aligned with the secured together body sections, said first and second blade-receiving receptacles having first and second sides corresponding to said body section respectively, said free ends of said spring contact arms of said first and second arrays of said first terminal element being disposed along said second side of said first and second blade-receiving receptacles and adapted to be deflected outwardly by corresponding second sides of respective first and second mating bus bar members, and said free arms of said spring contact arms of first and second arrays of said second terminal element being disposed along said first side of said first and second blade-receiving receptacles respectively, and adapted to be deflected outwardly by corresponding first sides of respective first and second mating bus bar members.

18. The method of claim 17 further including the steps of:

disposing housing means around said body portions and insulating means, said housing means including means for securing said body portions and insulating means together.

* * * * *